US005673663A

United States Patent [19]

Kim

[11] Patent Number: 5,673,663

[45] Date of Patent: Oct. 7, 1997

[54] NON-VALVE ENGINE DEVICE AND METHOD OF CONTROLLING THE SAME

[75] Inventor: Cheon-Il Kim, Kyungki-Do, Rep. of Korea

[73] Assignee: Hyundai Motor Co., Ltd., Seoul, Rep. of Korea

[21] Appl. No.: 637,435

[22] Filed: Apr. 25, 1996

[30] Foreign Application Priority Data

Apr. 25, 1995 [KR] Rep. of Korea ..... 95-9755

[51] Int. Cl.[6] ..... F01L 7/10

[52] U.S. Cl. ..... 123/190.4; 123/190.14; 123/80 BB

[58] Field of Search ..... 123/190.4, 190.14, 123/80 D, 80 BB

[56] References Cited

U.S. PATENT DOCUMENTS

| | | | |
|---|---|---|---|
| 1,578,332 | 3/1926 | McCumber | 123/80 D |
| 1,597,706 | 8/1926 | Aldous | 123/80 D |
| 1,657,399 | 1/1928 | Hughes | 123/80 D |
| 2,444,696 | 7/1948 | Riestra | 123/80 D |
| 4,813,392 | 3/1989 | Hansen et al. | 123/190.8 |
| 4,864,984 | 9/1989 | Blish | 123/190.14 |
| 5,355,849 | 10/1994 | Schiattino | 123/90.31 |

*Primary Examiner*—Erick R. Solis

[57] ABSTRACT

A non-valve engine device for a vehicle and a method of controlling the non-valve engine device are disclosed. The device includes a hemispherically configured, rotatable combustion chamber having an opening for matching with one of intake and exhaust ports, an engine control unit, a power transmission member connected to the engine control unit and the combustion chamber for rotating the chamber, and a piston disposed within a cylinder for alternatively moving towards and away from the combustion chamber, whereby the four stroke operation including suction, compression, explosion, and exhaustion, is carried out without a valve system.

20 Claims, 1 Drawing Sheet

NON-VALVE ENGINE DEVICE AND METHOD OF CONTROLLING THE SAME

BACKGROUND OF THE INVENTION

1. Field of the Invention

The present invention relates to a non-valve engine for a vehicle and more particularly, to a rotatable non-valve combustion chamber having a hemispheric configuration which is supported by bearings, whereby when the combustion chamber is rotated by a motor, an opening in the rotatable combustion chamber is alternatively matched with an input port and an output port for providing functions of suction and exhaust valves of a valve engine.

2. Description of Related Art

Various types of combustion chamber systems for a vehicle are known in the art. Generally, a combustion system for a vehicle includes a combustion chamber, and a suction valve and an exhaust valve for opening and closing an in-port and an out-port of the combustion chamber, respectively. In a stroke engine, the suction valve and the exhaust valve are opened and closed by operation of a piston.

However, such a conventional combustion chamber system for a vehicle suffers from a number of problems. For example, it is very complicated in structure due to the combination of valves and a cam shaft, it is noisy due to the operation of valves and the cam shaft, and it increases resistance in suctioning or exhausting air, causing transmission of flame in the combustion chamber.

SUMMARY OF THE INVENTION

Accordingly, it is an object of the present invention to provide a non-valve engine device for a vehicle, which eliminates the above problems encountered with conventional combustion chamber systems.

Another object of the present invention is to provide a method of controlling a non-valve engine device. The method includes the steps of: providing a rotatable combustion chamber having a surface and an opening on the surface; providing a plurality of intake ports radially extending from the surface of the combustion chamber; providing a plurality of exhaust ports, each being disposed between the plurality of intake ports; alternatively pressing a piston towards and away from the combustion chamber; and rotating the combustion chamber so as to carry out a four stroke operation having suction, compression, explosion, and exhaustion strokes.

A further object of the present invention is to provide a non-valve engine device for a vehicle, which includes an engine controller for checking and controlling r.p.m. (revolutions per minute), a power transmission member having a driving axle driven by an electric motor, a bevel gear rotated by the driving axle and bearings for supporting a shaft for providing rotational movement, and a rotatable combustion chamber having a hemispheric configuration and an opening on its hemispheric surface for selectively mating with one of in-ports and out-ports during the rotation of the chamber.

Still another object of the present invention is to provide a non-valve engine for a vehicle, which is simple in structure, inexpensive to manufacture, and durable in use.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a non-valve engine device and a method of controlling the same, including a rotatable combustion chamber having a surface and an opening on the surface; a plurality of intake ports radially extending from the surface of the combustion chamber; a plurality of exhaust ports, each disposed between the plurality of intake ports; moving means for moving towards and away from the combustion chamber; and rotating means for rotating the combustion chamber so as to carry out the four stroke operation without a valve system.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
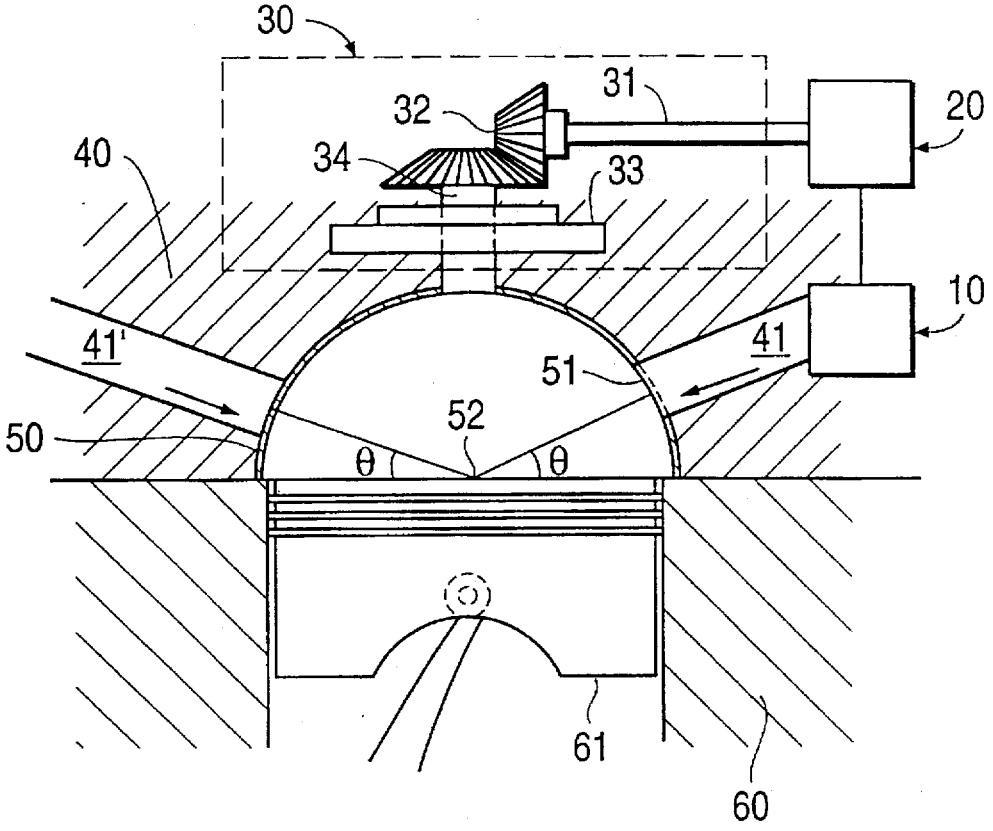
FIG. 1 diagrammatically shows a non-valve engine for a vehicle according to the embodiments of the present invention.
Figure 2:
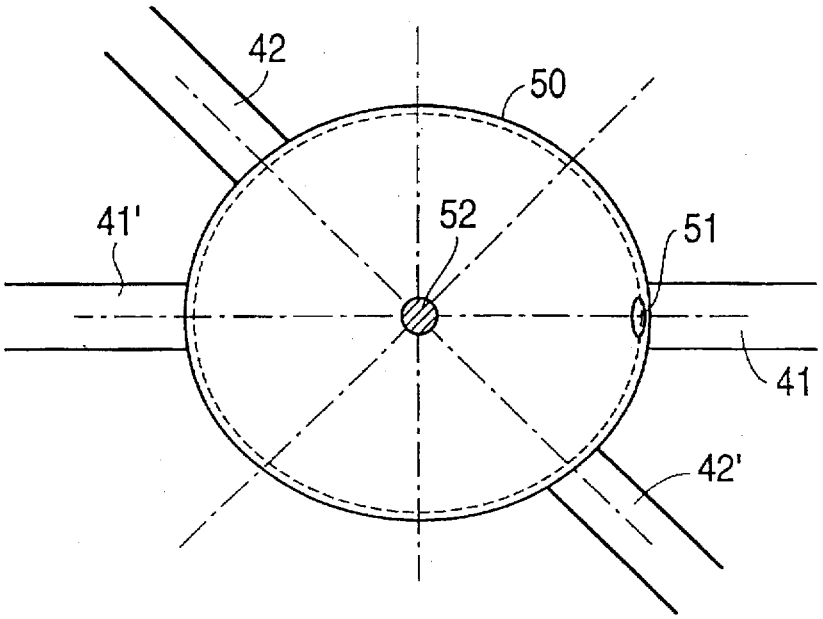
FIG. 2 is a cross-sectional view of a hemispherically configured, rotatable combustion chamber of the non-valve engine for a vehicle according to the embodiments of the present invention.

Referring now in detail to the drawings for the purpose of illustrating preferred embodiments of the present invention, the non-valve engine device for a vehicle as shown in FIGS. 1 and 2, comprises an engine control unit 10 (hereinafter "ECU") for checking and controlling revolution per minute (hereinafter "rpm") of the engine, an electric motor 20 operated under the control of the ECU 10, a power transmission member 30 operatively connected to the motor 20, and a hemispherically configured, rotatable combustion chamber 50 having an opening 51 on its surface. The combustion chamber 50 is operatively connected to the power transmission member 30 by which the combustion chamber 50 is rotated. The combustion chamber 50 is disposed within an engine head 40 for combusting a mixed air, and rotates 45° by 45° in one direction so that the opening 51 matches with one of first and second intake ports 41, 41' and first and second exhaust ports 42, 42', as it rotates. During the 180° rotation of the chamber 50, the four strokes including suction, compression, explosion, and exhaustion, for example, are completed.

As shown in FIG. 1, the power transmission member 30 includes a driving axle 31 driven by the motor 20, a bevel gear 32 connected to the driving axle 31, a driving shaft 34 being rotatable as the bevel gear 32 rotates, and bearings 33 surrounding the rotatable combustion chamber 50, so that upon operating the motor 20 by the ECU 10, the combustion chamber 50 rotates 45° by 45°.

As shown in FIG. 2, the first and second intake and exhaust ports 41, 41', 42, 42' radially extend from the hemisphere of the combustion chamber 50 located in the engine head 40. Each of the ports have an angle θ of approximately 30° extending from a center 52 of the combustion chamber 50. Each of the first and second exhaust ports 42, 42' forms approximately a 45° angle with either a vertical or horizontal axis, and each of the first and second intake ports 41, 41' forms approximately a 45° angle with the second and first exhaust ports 42', 42, respectively. These ports are positioned to match with the opening 51 of the combustion chamber 50 as it rotates, so that a mixed gas can enter into the chamber 50 through the intake port 41 or 41' lined up with the opening 51, and so that an exhaust gas can exit from the chamber 50 through the exhaust port 42 or 42' lined up with the opening 51.

As shown in FIG. 1, the combustion chamber 50 for combusting the air and gasoline mixture is provided with a piston 61 disposed within a cylinder 60. The piston 61 faces the bottom of the combustion chamber 50 so that, as the piston 61 moves up and down, twice, the four strokes of suction, compression, explosion, and exhaustion, are carried out in the non-valve engine device.

The non-valve engine device according to the embodiments of the present invention operates as follows. For example, the piston 61 moves down as the combustion chamber 50 rotates 45°. At this time, the opening 51 matches the first intake port 41. As a result, the air and gasoline mixture is suctioned into the chamber through the intake port 41 (suction stroke).

Then, as the combustion chamber 50 rotates another 45° continuously, the opening 51 is closed and simultaneously, the piston 61 moves up. Consequently, the gas mixture in the combustion chamber 50 is compressed by the piston 61 (compression stroke).

Then, as the combustion chamber 50 continuously rotates another 45°, the explosion is caused due to the compression using an ignition method (explosion stroke). At this time, the piston 61 moves down to actuate a crank (not shown).

Thereafter, the combustion chamber 50 rotates continuously to another 45°, and the opening 51 of the chamber 50 lines up with the first exhaust port 42. As the piston 61 moves up, the exhaust gas is pushed out of the chamber 50 through the first exhaust port 42 (exhaustion stroke).

Accordingly, the four strokes are carried out in the non-valve engine by rotating the combustion chamber for 180° and moving the piston 61 up and down, twice.

The above process is repeated under the control of the ECU 10. That is, the hemispherically configured combustion chamber 50 rotates continuously so that the suction, compression, exhaustion, and compression strokes are carried out as the opening 51 matches the second intake port 41' and then the second exhaust port 42'.

In result, as the combustion chamber 50 rotates 360°, two cycles of four strokes are performed, and the piston 61 moves up and down four times.

To activate the strokes, the ECU 10 checks the rpm of the engine and drives the motor 20 according to the checked rpm. Then the driving of the motor 20 causes the combustion chamber 50 to rotate.

Accordingly, the non-valve engine for a vehicle has a number of advantages compared with valve engine systems. For example, it is very simple in structure, the effect of a swirl can be increased due to the hemispherical configuration of the combustion chamber, and the efficiency of the engine is improved since the flame transmission is uniform during the explosion stroke.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A non-valve engine device comprising:

a non-valve combustion chamber having a hemispheric surface and one opening on the hemispheric surface;

first and second intake ports radially extending from the hemispheric surface of the combustion chamber;

first and second exhaust ports, each disposed between the first and second intake ports;

moving means for moving towards and away from the combustion chamber; and rotating means for rotating the combustion chamber so as to carry a four/stroke operation, wherein the first intake port and the first exhaust port are used during one four stroke operation of the non-valve engine device, the second intake port and the second exhaust port remaining as closed during said one four-stroke operation.

2. A non-valve engine device of claim 1, wherein the rotating means includes:

a motor, a driving shaft fixed to the center of the hemispheric surface of the combustion chamber and extending vertically therefrom, a driving axle connected to the motor and disposed perpendicular to the driving shaft, and a bevel gear connected to one end of the driving axle, whereby as the motor rotates, the combustion chamber is rotated.

3. A non-valve engine device of claim 2, wherein each of the first and second intake ports and the first and second exhaust ports extends in a straight line.

4. A non-valve engine device of claim 3, further comprising:

an engine control unit for determining an rpm of an engine and controlling the motor according to the determination.

5. A non-valve engine device of claim 4, wherein the rotating means further includes bearings surrounding the driving shaft.

6. A non-valve engine device of claim 4, wherein there is only one opening formed on the hemispheric surface of the combustion chamber.

7. A non-valve engine device of claim 2, wherein the first and second intake ports are disposed symmetrically to the first and second exhaust ports.

8. A non-valve engine device of claim 2, wherein the first intake port forms approximately a 45° angle with the second exhaust port, and the second intake port forms approximately a 45° angle with the first exhaust port.

9. A non-valve engine device of claim 8, wherein the first intake port forms approximately a 135° angle with the first exhaust port, and the second intake port forms approximately a 135° angle with the second exhaust port.

10. A non-valve engine device of claim 3, wherein at least one of the first and second intake ports and the first and second exhaust ports is disposed at approximately a 30° angle with respect to the center of the combustion chamber.

11. A non-valve engine device of claim 2, wherein the moving means includes a piston disposed within a cylinder, the piston moving towards and away from the combustion chamber twice, during approximately a 180° angle rotation of the combustion chamber, whereby said one four-stroke operation is performed during the 180° angle rotation of the combustion chamber.

12. A non-valve engine device of claim 11, wherein the moving means moves away from the combustion chamber during approximately a 45° angle rotation of the combustion chamber, and the one opening of the combustion chamber matches with the first intake port so as to carry out a suction stroke of said one four-stroke operation.

13. A non-valve engine device of claim 12, wherein during another approximately 45° angle rotation of the combustion chamber, the one opening of the chamber closes and the moving means moves towards the chamber so as to carry out a compression stroke of said one four-stroke operation.

14. A non-valve engine device of claim 13, wherein during another approximately 45° angle rotation of the combustion chamber, the one opening of the chamber remains closed and the moving means moves away from the chamber so as to carry out an explosion stroke of said one four-stroke operation.

15. A non-valve engine device of claim 14, wherein as the combustion chamber rotates approximately another 45°, the moving means moves towards the chamber and the one opening of the chamber matches with the first exhaust port so as to carry out an exhaustion stroke of said one four-stroke operation.

16. A method of controlling a non-valve engine device, the method comprising the steps of:

providing a non-valve combustion chamber having a hemispheric surface and one opening on the surface in the non-valve engine device;

providing first and second intake ports radially extending from the hemispheric surface of the combustion chamber;

providing first and second exhaust ports, each being disposed between the first and second intake ports;

moving a piston towards and away from the combustion chamber; and rotating the combustion chamber so as to carry out a four stroke operation of the non-valve engine device, wherein the first intake port and the first exhaust port are used during one four-stroke operation of the non-valve engine device, the second intake port and the second exhaust port remaining as closed during said one four-stroke operation.

17. A method of claim 16, wherein said rotating step includes the steps of:

first rotating the combustion chamber approximately 45° as the piston moves away from the combustion chamber; and lining up the one opening of the combustion chamber with the first intake port so as to carry out a suction stroke of said one four-stroke operation.

18. A method of claim 17, wherein said rotating step includes the steps of:

second rotating the combustion chamber another approximately 45° as the piston moves towards the combustion chamber; and closing the one opening of the combustion chamber so as to carry out a compression stroke of said one four-stroke operation.

19. A method of claim 18, wherein said rotating step includes the steps of:

third rotating the combustion chamber another approximately 45° as the piston moves away from the combustion chamber; and maintaining the one opening of the combustion chamber as closed to carry out an explosion stroke of said one four-stroke operation.

20. A method of claim 19, wherein said rotating step includes the steps of:

fourth rotating the combustion chamber another approximately 45° as the piston moves towards the combustion chamber; and lining up the one opening of the combustion chamber with the first exhaust port so as to carry out an exhaustion stroke of said one four-stroke operation.

* * * * *